US011327519B2

(12) United States Patent
Neumann et al.

(10) Patent No.: US 11,327,519 B2
(45) Date of Patent: May 10, 2022

(54) CONTROL LEVER WITH SLIDING GUIDE

(71) Applicant: FERNSTEUERGERÄTE Kurt Oelsch GmbH, Berlin (DE)

(72) Inventors: Thomas Neumann, Berlin (DE); Marcus Schinkel, Bestensee (DE); Volker Jahn, Heidesee (DE)

(73) Assignee: FERNSTEUERGERÄTE Kurt Oelsch GmbH, Berlin (DE)

( * ) Notice: Subject to any disclaimer, the term of this patent is extended or adjusted under 35 U.S.C. 154(b) by 188 days.

(21) Appl. No.: 16/622,318

(22) PCT Filed: Jun. 29, 2018

(86) PCT No.: PCT/DE2018/100600

§ 371 (c)(1),
(2) Date: Dec. 13, 2019

(87) PCT Pub. No.: WO2019/011373

PCT Pub. Date: Jan. 17, 2019

(65) Prior Publication Data

US 2020/0201376 A1 Jun. 25, 2020

(30) Foreign Application Priority Data

Jul. 14, 2017 (DE) ..... 10 2017 115 863.4

(51) Int. Cl.

| | |
|---|---|
| ***G05G 1/015*** | (2008.04) |
| ***G05G 1/04*** | (2006.01) |
| ***G05G 5/05*** | (2006.01) |

(52) U.S. Cl.

CPC ..... *G05G 1/015* (2013.01); *G05G 1/04* (2013.01); *G05G 5/05* (2013.01); *G05G 2700/02* (2013.01)

(58) Field of Classification Search

CPC ..... G05G 1/015; G05G 1/04; G05G 5/03; G05G 5/05; G05G 2700/02; G05G 2505/00

See application file for complete search history.

(56) References Cited

U.S. PATENT DOCUMENTS 3,095,754 A * 7/1963 Mayon ..... B62D 11/183 74/471 R
5,229,742 A * 7/1993 Miyamoto ..... G05G 5/05 338/128

(Continued)

FOREIGN PATENT DOCUMENTS

DE 202010000176 U1 6/2011
EP 0671604 A1 9/1995

(Continued)

OTHER PUBLICATIONS

Dr. Kapelevich, A., Dr. Taye, E. (2012) Applications for Self-Locking Gears. GearSolutions. https://gearsolutions.com/features/applications-for-self-locking-gears/ (Year: 2012).*

*Primary Examiner* — Joseph Brown
(74) *Attorney, Agent, or Firm* — Smartpat PLC

(57) ABSTRACT

A manual controller for controlling a machine comprises a mounting platform and a control lever. The control lever is mounted in a joint on the mounting platform so that it can pivot about an axis. A position sensor detects the deflection of the control lever and generates a signal corresponding to the deflection. An evaluation and processing unit processes the signal from the position sensor and controls the machine according to the deflection. A return mechanism returns the control lever back to a starting position.

9 Claims, 5 Drawing Sheets

(56) References Cited

U.S. PATENT DOCUMENTS

| | | | | |
|---|---|---|---|---|
| 5,986,585 | A | 11/1999 | Pusch | |
| 6,067,782 | A | 5/2000 | Diekhans | |
| 2008/0142642 | A1* | 6/2008 | Marino | B64C 13/507 244/223 |
| 2012/0025030 | A1 | 2/2012 | Stachniak et al. | |
| 2013/0133456 | A1* | 5/2013 | Matsushita | F16H 61/24 74/473.3 |
| 2015/0268691 | A1 | 9/2015 | Schaub et al. | |

FOREIGN PATENT DOCUMENTS

| | | | | |
|---|---|---|---|---|
| EP | 0856453 | A2 | 8/1998 | |
| EP | 2924535 | A2 | 9/2015 | |
| JP | 2008181478 | A | 8/2008 | |
| JP | 2009301097 | A | 12/2009 | |
| JP | 2011100333 | A | 5/2011 | |
| WO | 2008017344 | A1 | 2/2008 | |
| WO | WO-2019011373 | A1 * | 1/2019 | G05G 5/05 |

* cited by examiner

CONTROL LEVER WITH SLIDING GUIDE

TECHNICAL FIELD

The disclosure relates to a manual controller for controlling a machine.

BACKGROUND

Manual controllers are often used to control heavy machines. They are used to control cranes, wheel loaders, excavators, and forklifts or as speed controllers for rail vehicles and ships, for example. They are operated like a joystick. In general, many types of machines that are operated manually can be controlled with a manual controller. Modular designs support the use of a manual controller in many arrangements for machine controllers.

The machine is controlled based on the angular position of the control shaft, which is connected to the control lever. The angular position can be detected with or without contact. Arrangements in which the angular position is detected electro-optically by means of an encoder disk are known. However, the angular position can also be detected electronically using a potentiometer, for example.

There are manual controllers that only operate on one axis, but multi-axis manual controllers are also used. Accordingly, the multi-axis manual controller has at least two non-parallel control shafts driven via a suitable transmission.

A remote control to control vehicles with a maneuvering device are known from DE 20 2010 000 176, whereby the remote control is equipped with an input device and in which the degrees of freedom of motion of the vehicle to be controlled are mapped to the degrees of freedom of motion of the input device.

EP 0 671 604 A1 describes a joystick having two potentiometers that are linked to a control lever via a gimbal. Each position of the control lever is associated with a corresponding position of the sliding contact of the potentiometer so that the values of the voltages detected on the potentiometer terminals can be fed to an evaluation circuit. A device is proposed for the evaluation circuit to convert an at least one-dimensional mechanical deflection to a corresponding electrical value equal to the amount of this deflection in which one end of a pair of sliding contacts is controlled with electrical control signals via at least two contact surfaces. The other end of the pair of sliding contacts is moved over the number of parallel conductive tracks required for a specific resolution. Due to the displacement of the pair of sliding contacts, the control signals are fed via the contacted conductor tracks on the end thereof as evaluation signals.

EP 0856 453 A2 describes an electro-hydraulic steering system for vehicles that has manual steering and automatic steering (autopilot), which is activated via a switch. The steering system comprises at least one hydraulic steering cylinder for adjusting the steerable wheels, at least one sensor for determining current values of the wheel turning angle, at least one electrically operated hydraulic control valve which controls the pressurization of the steering cylinder with hydraulic fluid and at least one automatic steering signal generator for generating electrical steering signal setpoints for the wheel steering angle. In each case, the automatically generated steering signal setpoints and the current values of the wheel steering angle are fed to an electronic control and evaluation device. This control and evaluation device determines an electrical control signal for the hydraulic control valve from the current value of the wheel steering angle and the automatically generated steering signal setpoint. A steering signal generator is provided for the manual steering that also generates a corresponding electrical steering signal setpoint from a manual movement, which is also fed to the control and evaluation device. Depending on which steering is active, the control and evaluation device evaluates the setpoints of the manual or automatic steering signal. A control lever (joystick) can also be used as a manual steering signal generator.

SUMMARY

The object of the invention is to avoid the disadvantages of the prior art and to provide a manual controller for controlling a machine in which the user immediately receives haptic feedback from the manual controller in relation to the deflection.

The object is achieved in that in a manual control generator for controlling a machine includes a mounting platform. A control lever is mounted in a joint on the mounting platform so that it can pivot about an axis. A position sensor detects the deflection of the control lever and generates a signal corresponding to the deflection. An evaluation and processing unit processes the signal from the position sensor and controls the machine according to the deflection. A return mechanism returns the control lever back to the starting position. A sliding guide on the control lever is provided, whereby a sliding block, which is guided along a deflection curve of the sliding guide, determines the progression of force required for the deflection of the control lever.

The return mechanism of the control lever of a manual controller combines many advantages over previously used systems. This allows the restoring forces, force-deflection diagrams, optional force variations, and even asymmetric force progressions to be adapted by changing only one component, namely the sliding guide. This sliding guide is a curve segment that is permanently connected to the handle of the manual controller, although if necessary, said sliding guide can be designed to be exchangeable by means of a threaded connection and/or suitable plug connections. In this case the deflection curve and/or the contour of the curve segment primarily determines the progression of the restoring forces.

An advantageous embodiment of the manual controller is then achieved in that the sliding block or the sliding guide is elastically preloaded. Through a concave contour on the curve segment, a lever, for example, is moved away from the attachment point of an elastic element on the curve segment via a sliding block formed as a thrust ball bearing, and the distance between the attachment points increases. As a result of this, it is possible to realize restoring forces which act between the sliding guide and the sliding block. For example, the thrust ball bearing, which forms the sliding block, rotatably mounted via the lever is pulled by means of elastic elements on the sliding guide, which is formed as a cam disk. The sliding block follows the curve contour when the control lever is deflected. This leads to a non-linear increase and/or a progressive variation of the restoring force. Such a variation of force is desired especially for steering joysticks.

In a further preferable embodiment of the manual controller, the sliding block or the sliding guide is elastically preloaded by a spring. Springs are commercially available components that are available in various sizes. It is then easy to construct the manual controller with sliding guide. The restoring force is preferably realized via two tension springs.

The resulting redundancy thus fulfills the requirements for many safety-related applications. The manual controller can be built very compactly with only few components. In spite of the compactness, it is still possible to generate relatively large restoring torques. Another big advantage is the low wear of the return mechanism due to the design.

A further preferred variant of the manual controller is achieved in that the deflection curve is designed to be variable and adjustable using an adjusting element. This measure serves to ensure that the deflection curve can be adapted to the needs of the user. For this purpose, the deflection curve exchanged completely or in segments, for example. Designs are also conceivable in which the deflection curve itself can be partially or completely changed by moving elements. By means of an adjustment mechanism with suitable adjusting elements, it would also be possible to change the shape and/or form of the deflection curve.

An advantageous embodiment of the manual controller is furthermore obtained by providing at least one pivot point and/or shoulder for the sliding block in the deflection curve. It is not only possible to influence the progressivity of the force via the shape of the curve segment, but is also possible to realize center pivots and force surges using pivot points and shoulders, for example.

In an advantageous embodiment of the manual controller, a tracking device with a frame and/or a housing is provided. The tracking device is arranged on the mounting platform in this case. Furthermore, the joint is provided in the frame and/or the housing. The control lever of the manual controller then assumes the deflected position that is also associated with the machine. The control lever is always returned to a relative starting position after a control command. This starting position of the control lever is then deflected separately.

The manual controller then preferably has a control unit which then readjusts a drive of the tracking device to an assigned position, whereby the assigned position is determined by the machine controlled with the deflection. The effect of the control instruction is thus determined and assigned to a position of the control lever. In a rail vehicle, for example, the speed can be set by operating the manual controller, whereby a setpoint is defined. When the rail vehicle has reached the speed setpoint, the control unit adjusts the control lever by moving it through a corresponding angle, which is assigned to this speed. The user immediately sees which setpoint has been set.

An advantageous embodiment of the manual controller results from the fact that the drive has a rotor, which adjusts the tracking device by an angle (3, which determines the position assigned to the machine adjusted by the deflection angle co. This measure causes the tracking device to rotate with the control lever through an assigned angle with the rotor. This saves space, and the user can easily determine the corresponding position of the control lever.

In a preferred embodiment of the manual controller, the drive of the tracking device has a gearbox. The drives often rotate too fast so that the speed can be reduced by a gearbox. Preferably, the gearbox of the drive of the tracking device is then provided as a self-locking gearbox.

In a further advantageous embodiment of the manual controller, the return mechanism has a spring element. With the spring element, the control lever is returned after a deflection of the control lever to a starting position against the spring force due to the spring element. In particular, damping means can be provided here to avoid the control lever from overshooting. Suspending the control lever between two spring elements not only has a damping effect, but also provides redundancy, which makes the manual controller more failure-proof.

Further embodiments and advantages result from the subject of the dependent claims and the drawings with the accompanying descriptions. An embodiment is explained in more detail in the following with references to the accompanying drawings. The invention should not be limited solely to the embodiments listed. They are only intended to illustrate the invention.

DETAILED DESCRIPTION

Figure 1:
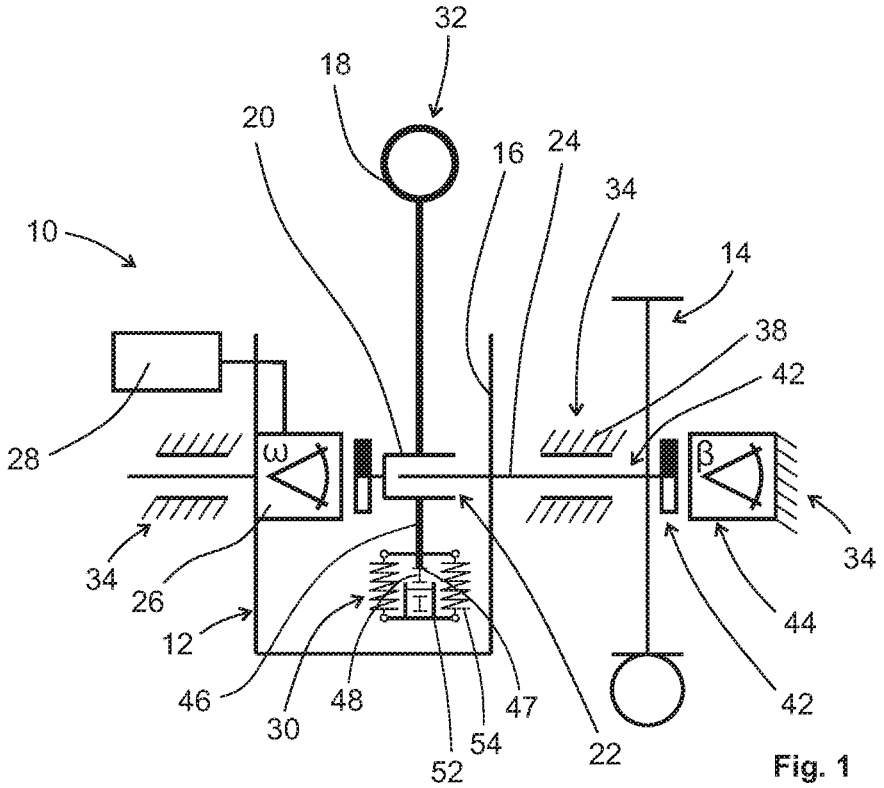
FIG. 1 is a schematic diagram of the basic principle of a manual controller with a tracking device in a front view.

FIG. 1 shows a basic diagram 10 of a manual controller 12 with a tracking device 14. The manual controller 12 serves to control a machine, for example a wheel loader. The manual controller 12 is arranged on a mounting platform 16. The manual controller 12 comprises a control lever 18, which is attached to a control shaft 20. The control shaft 20 is rotatably mounted in the mounting platform 16 and forms a joint 22. The control lever 18 is thus provided to be deflectable via a pivot axis 24.

A position sensor leader 26 detects every deflection ω of the control lever 18 and generates an angle signal associated with the corresponding deflection. The angle ω of the deflection is also referred to in the following as the guide angle ω. An evaluation and processing unit 28 processes the signal of the position sensor 26. A machine is controlled through the guide angle ω according to the deflection. A return mechanism 30 always returns the control lever 18 to its starting position 32 without applying any force. The control lever 18 is located in a housing 34 of the tracking device 14 of the manual controller 12.

A tracking device 14 actively operates the control shaft 20 with an actuator 36. For this purpose, the position sensor 26 generates the angle signal, which corresponds to the respective deflection of the control lever 20 around the pivot axis 24. The position relative to the mounting platform 16 can change, provided that the tracking device 14 has also changed position.

The tracking device 14 also comprises a motor drive 38, which controls a rotor 42 via a gearbox 40. The motor drive 38 is preferably designed as a DC motor. The evaluation and processing unit 28 controls the motor drive 38 such that the rotor 42 rotates through an angle β with respect to the housing 34. The rotor 42 thus changes its angular position relative to the housing 34.

The rotor 42 is controlled via a control unit 44. The angle β of the rotor 42 is referred to as the feedback angle, which is measured relative to the housing 34. The actuator 36 has a self-locking property so that the position of the rotor 42 cannot be changed by applying force to the control lever 18.

The control lever 18 is connected to a sliding guide 46. The bottom of the sliding guide 46 in this diagram is formed with a deflection curve 47. The shape of the deflection curve 47, for example as shown in FIGS. 7*a* to 7*d*, has a significant influence on the restoring forces of the control lever 18. A thrust ball bearing 48 moves along this deflection curve 47 when the control lever 18 is operated. The thrust ball bearing 48 forms a sliding block 50 for the sliding guide 46. The sliding block 50 is attached to a lever 52. The spring elements 54 press or pull the sliding block 50 against the sliding guide 46. The sliding block follows the deflection curve 47 when the control lever 18 is operated (see also FIG. 2).

Figure 2:
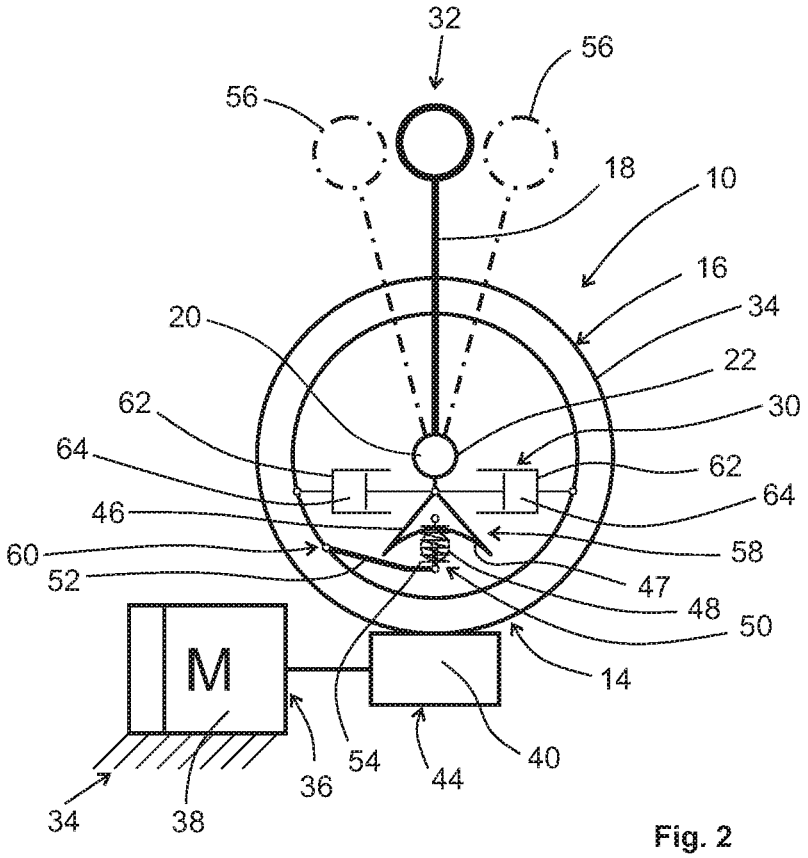
FIG. 2 is a schematic diagram of a manual controller with a tracking device in a neutral deflection in a side view.

FIG. 2 shows a schematic side view of the manual controller 12 according to FIG. 1. Wherever FIG. 2 corresponds to FIG. 1, the same reference signs will be used. The manual controller 12 comprises the housing 34 and the mounting platform 16. The control lever 18 is provided with the joint 22 in the assembly platform 16 to enable deflectability. Deflections of the control lever 18 are indicated with dashed lines 56 representing the control lever 18. The sliding guide 46 is provided on the bottom section 58 of the control lever 18. The thrust ball bearing 48 is arranged on the end 58 of the lever 52. The other end 60 of the lever 52 is flexibly attached to the assembly platform 16. The spring element 54 preloads the lever 52. This presses the sliding block 50 against the sliding guide 46. In FIG. 1 the control lever 18 is in the starting position 32. The spring element 54 keeps the control lever 18 under tension in this starting position 32.

When the control lever 18 is deflected, the spring element 54 is compressed or expanded or released according to the sliding guide 46. This allows the forces acting on the control lever 18 when deflected to be defined based on the shape of the curve. The spring forces of the spring element 54 can also be designed depending on the degree of hardness that said spring forces influence the forces applied to the control lever 18 upon deflection.

The position sensor 26 detects every deflection ω of the control lever 18 and generates an angle signal associated with the guide angle. The evaluation and processing unit 28 processes the signal of the position sensor 26. A machine is controlled through the guide angle co according to the deflection. The return mechanism 30 comprising here in particular the spring element 54, in interaction with the sliding block 50 and the sliding guide 46, always returns the control lever 18 without force to its starting position 32. The damping module 62 in the present embodiment comprises two damping elements 64. The control lever 18 is arranged between these damping elements 64. The shape of the curve of the sliding guide 46 supports the return process due to its shape since the spring elements 54 can be guided accordingly from a tensioned state to a released state.

The tracking device 14 actively acts with the actuator 36 on the control shaft 20 as described in FIG. 1. As a result, a user immediately receives feedback on the status of the actual control state of the machine. For this purpose, the deflection of the control lever 18 is fed to the evaluation and processing unit 28. The machine is controlled corresponding to the deflection via the evaluation and processing unit 28. The machine in turn sends a control signal to the tracking device 14, which moves the control lever 18 with the tracking device 14 accordingly. The user thus always knows the state of the machine to be operated with the manual controller 10.

Figure 3:
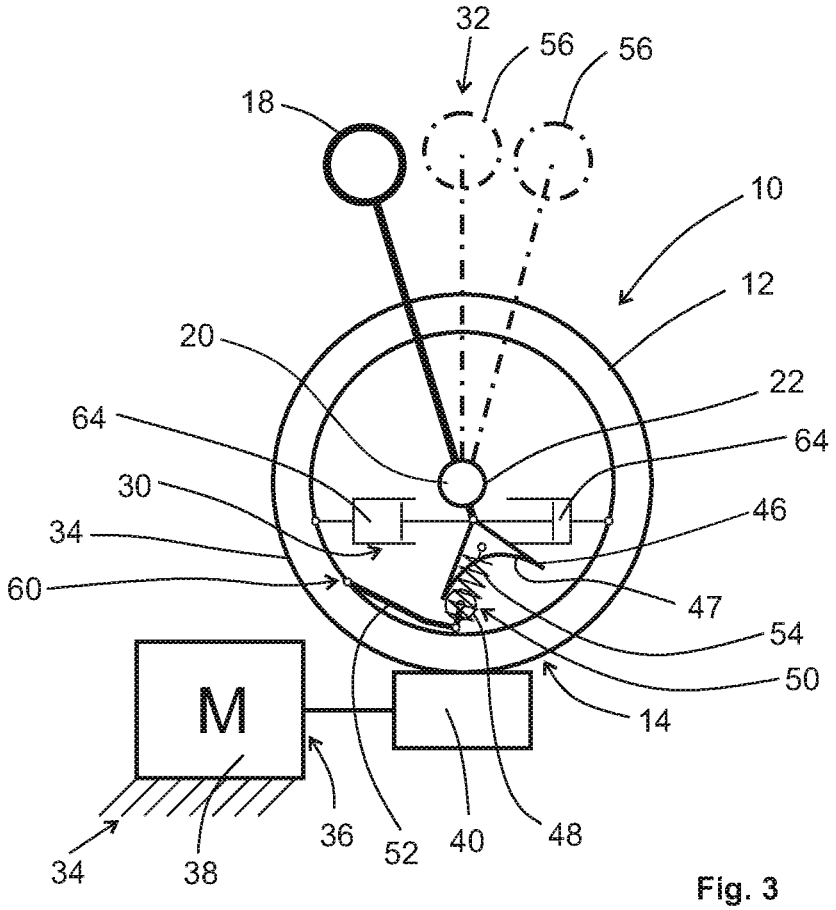
FIG. 3 is a schematic diagram according to FIG. 2 of a manual controller with a tracking device with a deflection in a side view.

FIG. 3 shows the manual controller 12 according to FIG. 2. In contrast to FIG. 2, though, the control lever 18 is shown in a deflected state. The spring element 54 is subject to high tension due to the sliding guide 46 and the sliding block 50. Whether the tension is due to expansive or compressive forces of the spring elements 54 is irrelevant to the actual technical situation. The spring forces of the spring element 54 in this deflected position have a particularly strong effect on the control lever 18, which is firmly connected to the sliding guide 46. As a result of this, the user of the manual controller 12 can determine how far control lever 18 is deflected based solely on the forces acting on it.

Figure 4:
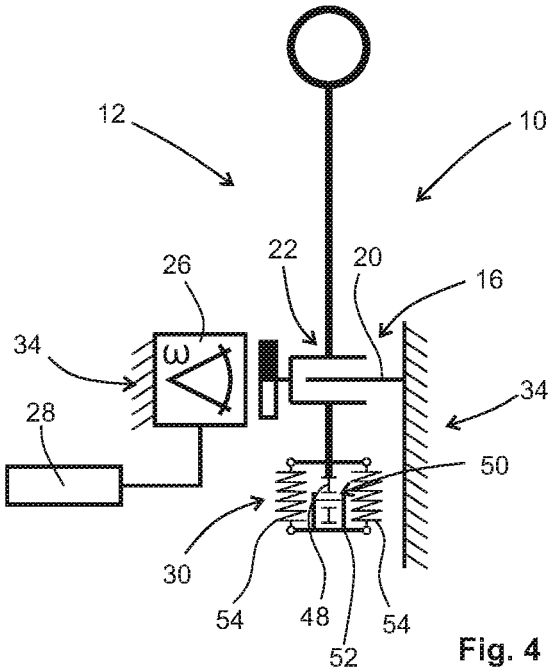
FIG. 4 is a schematic diagram of the manual controller without a tracking device in a front view.

FIG. 4 shows another embodiment of the manual controller 12. The manual controller 12 is shown schematically without the tracking device 14. FIG. 4 shows a front view of the manual controller 12 shown in a basic diagram. This type of manual controller 12 also serves to control a machine. The manual controller 12 is arranged on the mounting platform 16 and comprises the housing 34. The control lever 18 is attached to the control shaft 20, whereby the control shaft 20 is rotatably mounted in the mounting platform 16, forming the joint 22.

The position sensor leader 26 detects every deflection ω of the control lever 18 and generates an angle signal associated with the corresponding deflection. The evaluation and processing unit 28 processes the signal of the position sensor 26. A machine is controlled through the guide angle ω according to the deflection. The return mechanism 30 always returns the control lever 18 to its starting position 32 without applying any force. The control lever 18, as previously described in the embodiment, is firmly connected to the sliding guide 46.

Figure 5:
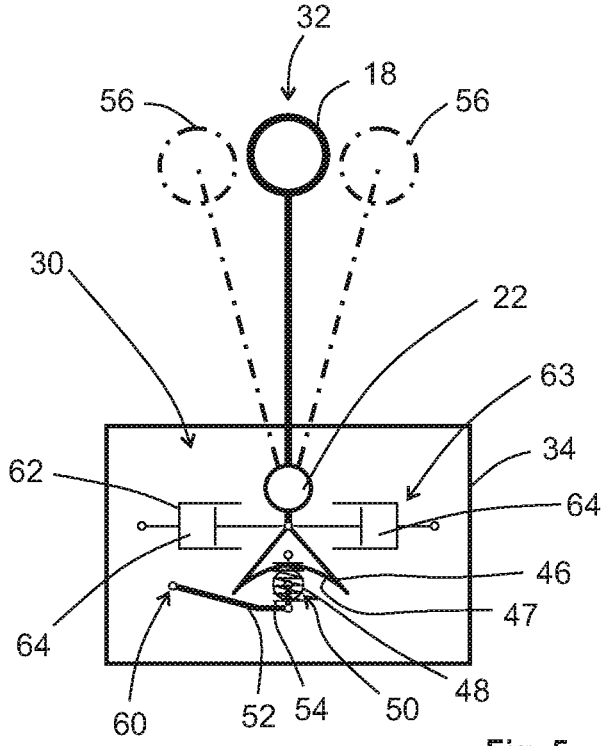
FIG. 5 is a schematic diagram of a manual controller without a tracking device in a neutral deflection in a side view.
Figure 6:
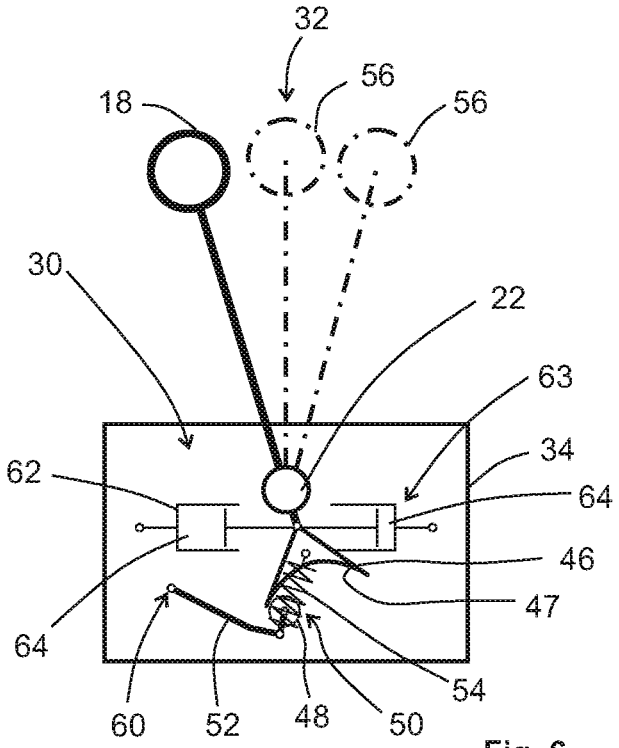
FIG. 6 is a schematic diagram according to FIG. 5 of a manual controller with a tracking device with a deflection in a side view.

FIG. 5 and FIG. 6 show a side view of the embodiment in FIG. 4. Wherever the components in the figures correspond, the same reference signs are used here as well. FIG. 5 shows the manual controller 12, whereby the control lever 18 is in the starting position 32 or in a rest position. In FIG. 6 the control lever 18 of the manual controller 12 is shown after deflection through the guide angle ω. The sliding guide 46 has the shape of a curve with the concave side opening to the bottom. A parabola that opens to the bottom could also be provided here, for example. Basically, any curved shape that is technically feasible is conceivable here.

Various curve shapes are therefore shown as examples in FIGS. 7*a* to 7*d*. The thrust ball bearing 48 moves along this curved form as the sliding block 50 for the sliding guide 46 when the control lever 18 is operated. The sliding block 50 is attached to the lever 52. The spring elements 54 press or pull the sliding block 50 against the sliding guide 46. The spring forces increase or decrease depending on the position of the sliding guide 46 with respect to the sliding block 50. This provides the user of the control lever 18 with a sense of its deflection. The stronger the deflection is, the greater the forces that need to be overcome to further deflect the control lever 18. The control lever 18 is arranged between the two damping elements 64 of the damping module 62. This helps to reduce the overshoot of the control lever 18 when returning to the starting position 32.

The sliding guide 46 can be designed such that it helps to prevent the control lever 18 from overshooting when returning the control lever 18 to the starting position 32. Additional damping means can provide additional support to this function to prevent the control lever 18 from overshooting. The damping means, for example, can be designed as a magnetically, pneumatically, or hydraulically driven element or as a friction element.

Figure 7A:
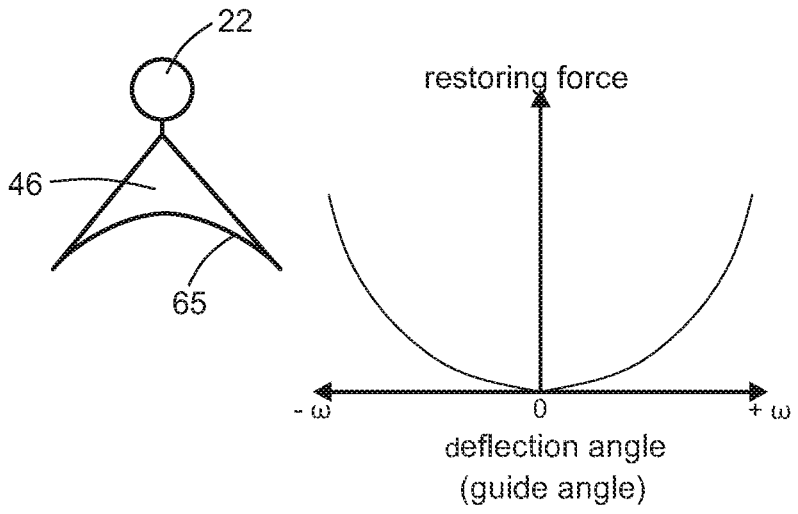
FIG. 7*a*-7*d* are schematic diagrams of different variants of the sliding guide and the corresponding curve of the restoring forces with respect to the deflection.
Figure 7B:
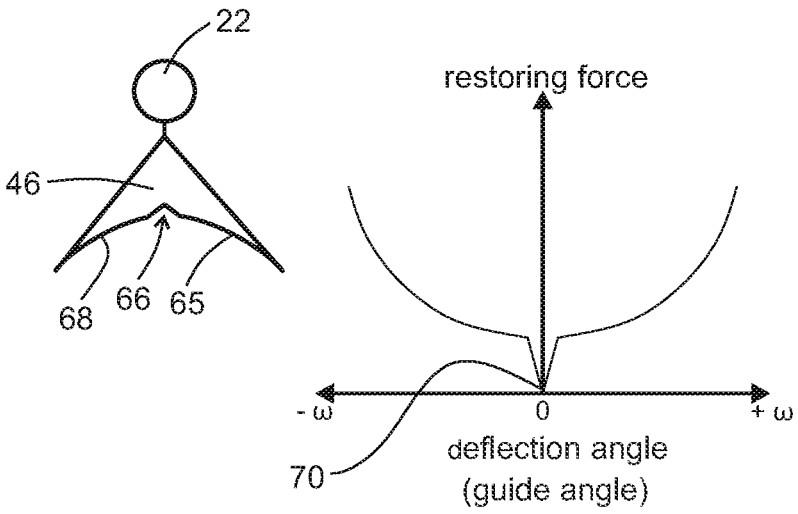
Figure 7C:
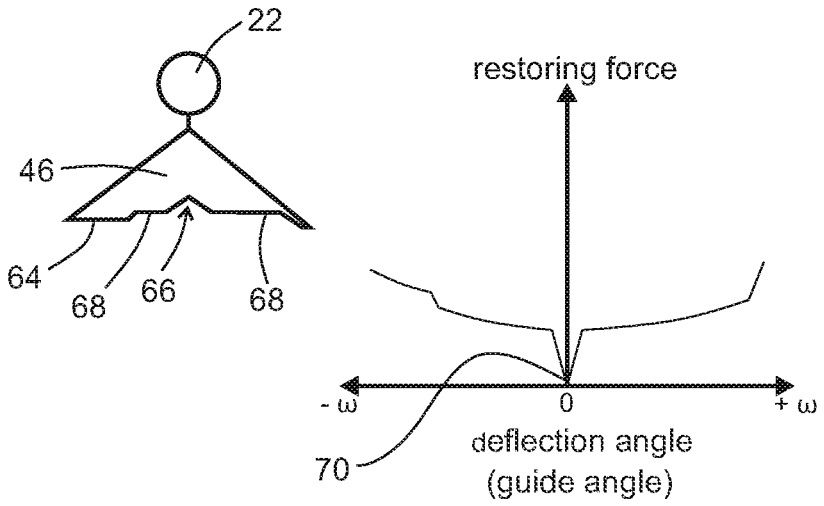
Figure 7D:
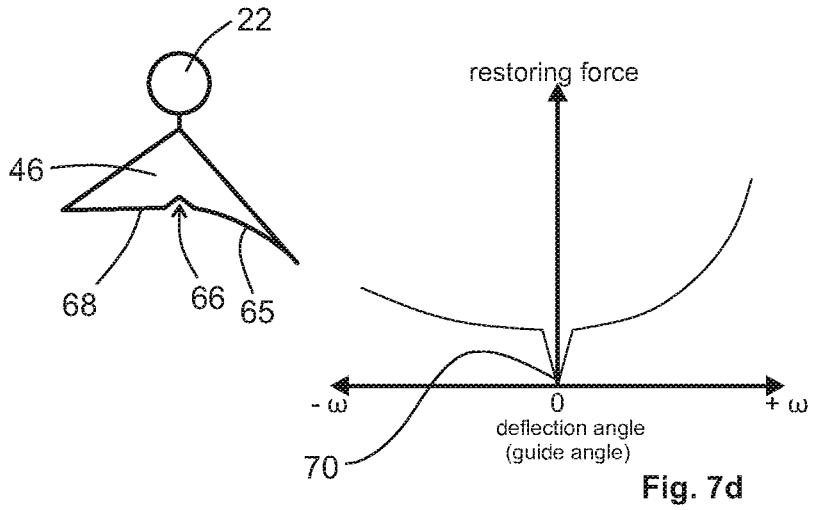

FIGS. 7*a* to 7*d* show sliding guides 46 with different curve profiles 65. The curve profiles 65 in particular have different curvatures. While the curve profile 65 in FIG. 7*a* is designed to be symmetric, the curve profiles 65 in FIGS. 7*b* to 7*d* are designed to be asymmetric. In addition to the sliding guide 46, a plot of the restoring forces against the guide angle ω of the control lever 18 is shown.

The sliding guides 46 in FIGS. 7*b* to 7*d* have notches 66 or shoulders 68. The notches 66 serve as pivot points 70 for the control lever 18. In this case the shoulders 68 allow the most uniform force distribution possible in terms of restoring forces. The sliding block 50 snaps in place in the notches 66 of the curve profiles 65. These pivot points 70 can be seen immediately in the force curves on the right. In this case, a higher threshold force must be applied to move the control lever 18 out of the notch 66. The distribution of the restoring forces of the control lever 18 can thus be influenced by the curve profile 65 of the sliding guides 46 and adapted to obtain a desired haptic.

LIST OF REFERENCE SIGNS

10 Basic diagram of the manual controller
12 Manual controller
14 Tracking device
16 Mounting platform
18 Control lever
20 Control shaft
22 Joint
24 Pivot axis
26 Position sensor
ω Guide angle
28 Evaluation and processing unit
30 Return mechanism
32 Starting position
34 Housing
36 Actuator
38 Motor drive
40 Gearbox
42 Rotor
44 Control unit
46 Sliding guide
47 Deflection curve
48 Thrust ball bearing
50 Sliding block
52 Lever
54 Spring element
56 Dashed lines of the control lever
58 End of the lever with sliding block
60 End of the lever on the mounting platform
62 Damping module
64 Damping element
65 Cam profiles
66 Notch
68 Shoulder
70 Pivot point

What is claimed is:

1. A manual controller (12) for a machine, comprising:
a mounting platform (16);
a control lever (18), which is mounted in a joint (22) on the mounting platform (16) so that it can pivot about an axis (24);
a position sensor (26), which detects a deflection (w) of the control lever (18) and generates a signal corresponding to the deflection (w);
an evaluation and processing unit (28), which processes the signal from the position sensor (26) and controls the machine according to the deflection (ω);
a return mechanism (30), which returns the control lever (18) back to a starting position (32); and
a sliding guide (46) with a curve profile (65) on the control lever (18), whereby a sliding block (50), which is guided along a deflection curve (47) of the curve profile (65) of the sliding guide (46), determines a progression of force required for the deflection of the control lever (18),
wherein the curve profile comprises a neutral point which is a closest point along the curve profile to the joint (22),
wherein the sliding block (50) touches the neutral point when the control lever (18) is in a neutral position,
wherein the curve profile (65) is asymmetrical relative to a normal axis that extends through the neutral point, and
wherein the progression of force upon deflecting the control lever in one direction from the neutral position is different from the progression of force upon deflecting the control lever in an opposite direction from the neutral position.

2. The manual controller (12) according to claim 1,
wherein the sliding block (50) or the sliding guide (46) is elastically preloaded for the purpose of guiding.

3. The manual controller (12) according to claim 1,
wherein the sliding block (50) or the sliding guide (46) has a spring element (54) for the purpose of providing an elastic preload.

4. The manual controller (12) according to claim 1,
wherein at least one pivot point (70) and/or one shoulder (68) is provided in the deflection curve (47) for the sliding block (50).

5. The manual controller (12) according to claim 1,
further comprising a tracking device (14) with a frame and/or housing (34) which is arranged on the mounting platform (16), whereby the joint (22) is provided in the frame and/or housing (34) of the tracking device (14).

6. The manual controller (12) according to claim 5,
wherein a control unit (44) is provided, which controls a drive (36) of the tracking device (14) to move the control lever (18) to an assigned position.

7. The manual controller (12) according to claim 6,
wherein the drive (38) has a rotor (42), which moves the tracking device (14) through an angle (β), with which a position assigned to the machine being controlled according to the deflection (ω) is defined.

8. The manual controller (12) according to claim 6,
wherein the drive (38) of the tracking device (14) has a gearbox (40).

9. The manual controller (12) according to claim 8,
wherein the gearbox (40) of the drive (38) of the tracking device (14) is self-locking.

* * * * *